US009570864B1

(12) United States Patent
Moyer et al.

(10) Patent No.: US 9,570,864 B1
(45) Date of Patent: Feb. 14, 2017

(54) CABLE ASSEMBLY HAVING A DEVICE CONNECTION END WITH A LIGHT SOURCE

(71) Applicant: Organization Solutions, LLC, Haddon Township, NJ (US)

(72) Inventors: Christopher Moyer, Haddon Township, NJ (US); Thomas Colby Moyer, Merchantville, NJ (US); Adip Dutta, West Bengal (IN)

(73) Assignee: Organization Solutions, LLC, Haddon Township, NJ (US)

( * ) Notice: Subject to any disclaimer, the term of this patent is extended or adjusted under 35 U.S.C. 154(b) by 0 days.

(21) Appl. No.: 14/879,117

(22) Filed: Oct. 9, 2015

(51) Int. Cl.
*H01R 3/00* (2006.01)
*H01R 13/717* (2006.01)
*H01R 13/66* (2006.01)

(52) U.S. Cl.
CPC ..... *H01R 13/7175* (2013.01); *H01R 13/665* (2013.01)

(58) Field of Classification Search
CPC . H01R 13/465; H01R 13/6641; H01R 13/717; H01R 13/7175
USPC ..... 439/488–490
See application file for complete search history.

(56) References Cited

U.S. PATENT DOCUMENTS 6,980,204 B1 12/2005 Hawkins et al.
7,004,595 B1 * 2/2006 Stoddard ..... H01R 13/6641 362/114
7,393,237 B2 * 7/2008 Kuo ..... H01R 13/6691 362/249.01
7,683,752 B1 * 3/2010 Huss ..... H01H 85/20 337/206
7,736,174 B2 * 6/2010 Bhosale ..... F21V 33/00 365/95
8,330,390 B2 12/2012 Hum et al.
8,740,640 B2 6/2014 Hardy
(Continued)

FOREIGN PATENT DOCUMENTS

CN 203674524 6/2014

OTHER PUBLICATIONS www.Amazon.com/Cellet-Micro-Charging-Android-Samsung/dp/B00TVACIC8. 5 pages.
(Continued)

*Primary Examiner* — Chandrika Prasad
(74) *Attorney, Agent, or Firm* — Joseph E. Maenner; Maenner & Associates, LLC

(57) ABSTRACT

An electronic charging cable assembly is disclosed. The assembly includes a power connection end adapted to be electrically connected to an electrical power source and a device connection end adapted to be logically connected to an electronic device. The device connection end is electrically connected to the power connection end. A light source is located at the device connection end such that, when the power connection end is electrically connected to the electrical power source and the device connection end is not connected to the electronic device, the light source is illuminated and, when the power connection end is electrically connected to the electrical power source and the device connection end is connected to the electronic device, the light source is not illuminated. An exemplary electrical circuit used to provide this feature and a method of operating the electronic charging cable assembly are also disclosed.

15 Claims, 2 Drawing Sheets

(56) References Cited

U.S. PATENT DOCUMENTS

| | | | | |
|---|---|---|---|---|
| 8,998,439 | B1 * | 4/2015 | Siddiqui | H01R 13/717 362/109 |
| 9,019,103 | B2 * | 4/2015 | Tedesco | G08B 13/1427 320/157 |
| 9,022,605 | B2 | 5/2015 | Bushnell et al. | |
| 2003/0194906 | A1 * | 10/2003 | Arkin | H01R 13/717 439/490 |
| 2005/0040788 | A1 * | 2/2005 | Tseng | H02J 7/0027 320/111 |
| 2005/0260884 | A1 * | 11/2005 | Yueh | H01R 13/6691 439/488 |
| 2010/0002421 | A1 | 1/2010 | Arnold, III | |
| 2010/0309657 | A1 | 12/2010 | Purdy et al. | |
| 2012/0019392 | A1 | 1/2012 | Yamamoto et al. | |
| 2013/0176738 | A1 | 7/2013 | Tinaphong et al. | |
| 2013/0308304 | A1 * | 11/2013 | Tuchrelo | H01R 13/7175 362/157 |
| 2015/0004832 | A1 * | 1/2015 | Homan | H01R 13/717 439/490 |
| 2015/0200499 | A1 * | 7/2015 | Siddiqui | H01R 13/701 439/490 |
| 2015/0255930 | A1 * | 9/2015 | Lee | H02H 3/22 361/91.5 |

OTHER PUBLICATIONS www.amazon.com/Discovery-Charger-Samsung-Smartphones-LED-Black/dp/B00ICHR740. 6 pages.
www.Amazon.com/Goal-Zero-14101-Stick-Light/dp/B004XRK06. 7 pages.
www.markfeldstein.com. Power Bank Instructions. 1 page.

* cited by examiner

CABLE ASSEMBLY HAVING A DEVICE CONNECTION END WITH A LIGHT SOURCE

BACKGROUND OF THE INVENTION

Field of the Invention

The present invention relates to a lighted USB cable assembly, and, in particular, to a lighted USB cable assembly that has a device connection end that is illuminated when the USB cable assembly is not plugged into an electronic device, and that is not illuminated when the USB cable assembly is plugged into the electronic device.

Description of the Related Art

USB cables are common devices for electrically charged electronic devices. These cables typically have a power connection end that is insertable into a power source, such as, for example, another electronic device, an electrical outlet, or any other source of electrical power. Oftentimes, the USB cables are illuminated at a device connection end to allow user to find the device connection end, and to plug-in an electronic device to the device connection end in the dark. A problem with these cables is that the illuminated end remains illuminated after plugging in the device or, if the illuminated end is de-illuminated, the illuminated end re-illuminates after the electronic device is fully charged. Either of these situations can be annoying to a user who may be trying to sleep in an otherwise darkened room.

It would be beneficial to provide a USB cable assembly that has an illuminated device connection end so that the user can find the device connection end in the dark to be able to plug the device connection end into an electronic device, but that no longer remains illuminated after the device connection end is plugged into the electronic device.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an electronic charging cable assembly. The assembly includes a power connection end adapted to be electrically connected to an electrical power source and a device connection end adapted to be logically connected to an electronic device. The device connection end is electrically connected to the power connection end. A light source is located at the device connection end such that, when the power connection end is electrically connected to the electrical power source and the device connection end is not connected to the electronic device, the light source is illuminated and, when the power connection end is electrically connected to the electrical power source and the device connection end is connected to the electronic device, the light source is not illuminated.

In another embodiment, the present invention is a method of charging an electronic device, comprising the steps of providing the electronic charging cable assembly described above; electrically connecting the power connection end to the electrical power source, thereby illuminating the light source; and electrically connecting the device connection end to the electronic device, thereby turning off the illumination of the light source.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
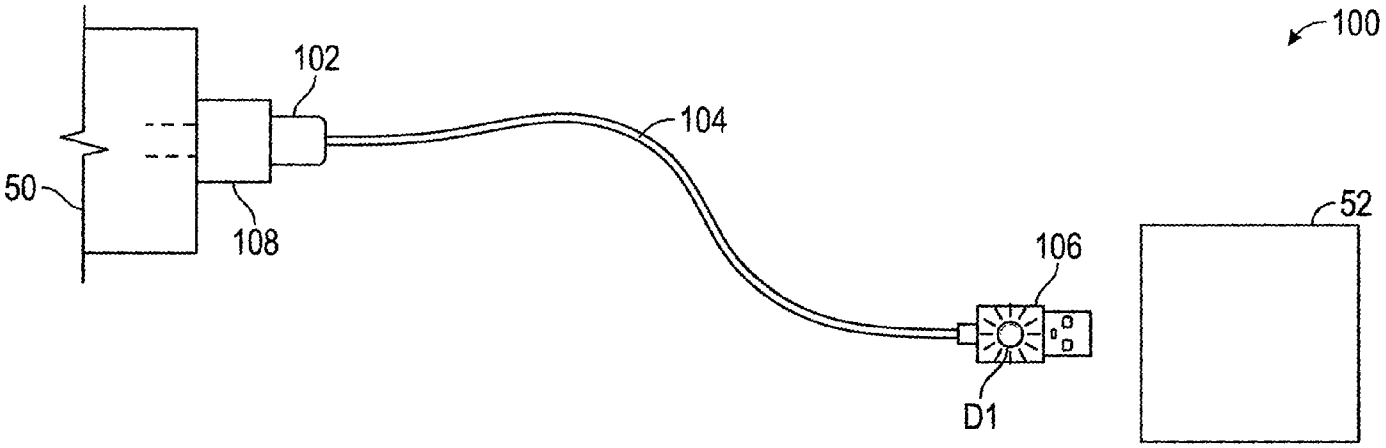
FIG. 1 shows a charging cable assembly according to a first exemplary embodiment of the present invention, with a device connection end unconnected and an LED diode at the device connection end being illuminated.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention is an electronic charging cable assembly that, when plugged into a power source, has a device connection end that illuminates so that the device connection end can be located in a darkened room but, when the device connection end is connected to an electronic device, the device connection end ceases to eliminate. The device connection end will not illuminate until the electronic device is disconnected from the device connection end.

Referring to FIG. 1, a cable assembly 100 according to an exemplary embodiment of the present invention is shown. While an exemplary cable assembly 100 includes a Universal Serial Bus ("USB") connector at at least one end, those skilled in the art will recognize that cable assembly 100 can be other types of cable assemblies as well.

Cable assembly 100 includes an electrical power connection end 102 that is adapted to be electrically connected to an electrical power source 50. Typically, electrical power connection end 102 is a USB connector. In an exemplary embodiment, electrical power source 50 can be a 110 V electrical outlet. In such a situation, an adapter 108 can be provided between electrical power source 50 and electrical power connection end 102 in order to transform the 110 V AC electrical power at electrical power source 50 into required DC voltage for properly charging an electronic device 52. Alternatively, electrical power connection end 102 can be directly plugged into a USB port of an electronic charging devices, such as, for example, a desktop computer, a USB port equipped desk clock, or other such electronic device.

Cable assembly 100 also includes a device connection end 106 that is adapted to be electrically connected to electronic device 52. Device connection end 106 is electrically connected to electrical power connection end 102 via a cable 104. Optionally, cable 104 can be omitted and device connection end 106 can be directly connected to electrical power connection end 102.

Device connection end 106 includes an illumination source, such as, for example, a light emitting diode D1, that illuminates when electrical power connection end 102 is connected to electrical power source 50, as shown in FIG. 1. While diode D1 is shown as a circular light, those skilled in the art will recognize that diode D1 can take other shapes as well.

Figure 2:
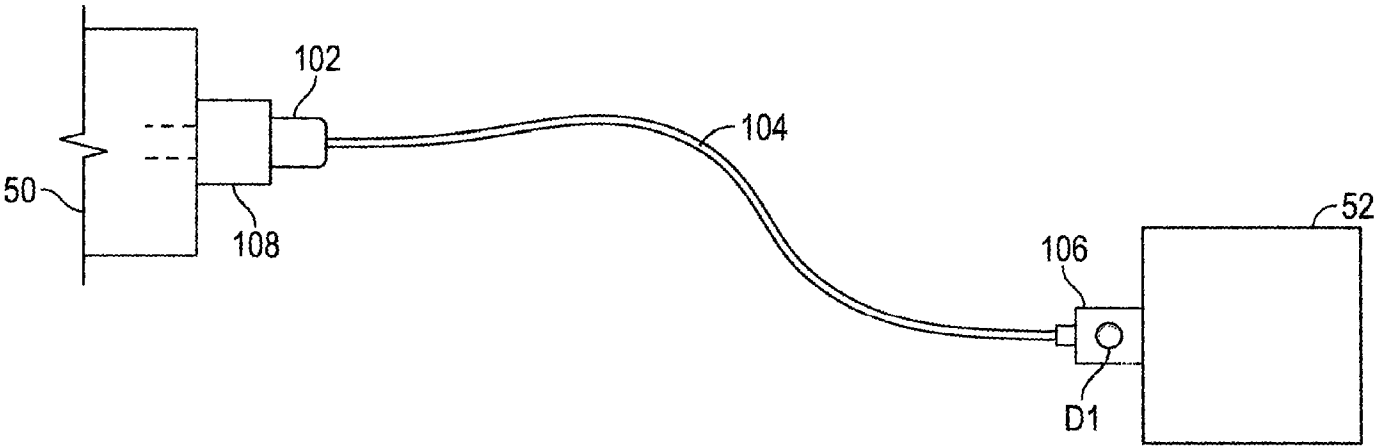
FIG. 2 shows the charging cable assembly shown FIG. 1 with the device connection and being connected to an electronic device and the LED diode at the device connection end not being illuminated.

As shown in FIG. 2 however, when electronic device 52 is electrically connected to device connection end 106, electronics within cable assembly 100 terminate electrical power to illumination source (diode D1) such that the illumination source is no longer illuminated. While electrical power connection end 102 is still electrically connected to electrical power source 50, diode D1 will not illuminate unless and until electronic device 52 is electrically disconnected from device connection end 52.

Figure 3:
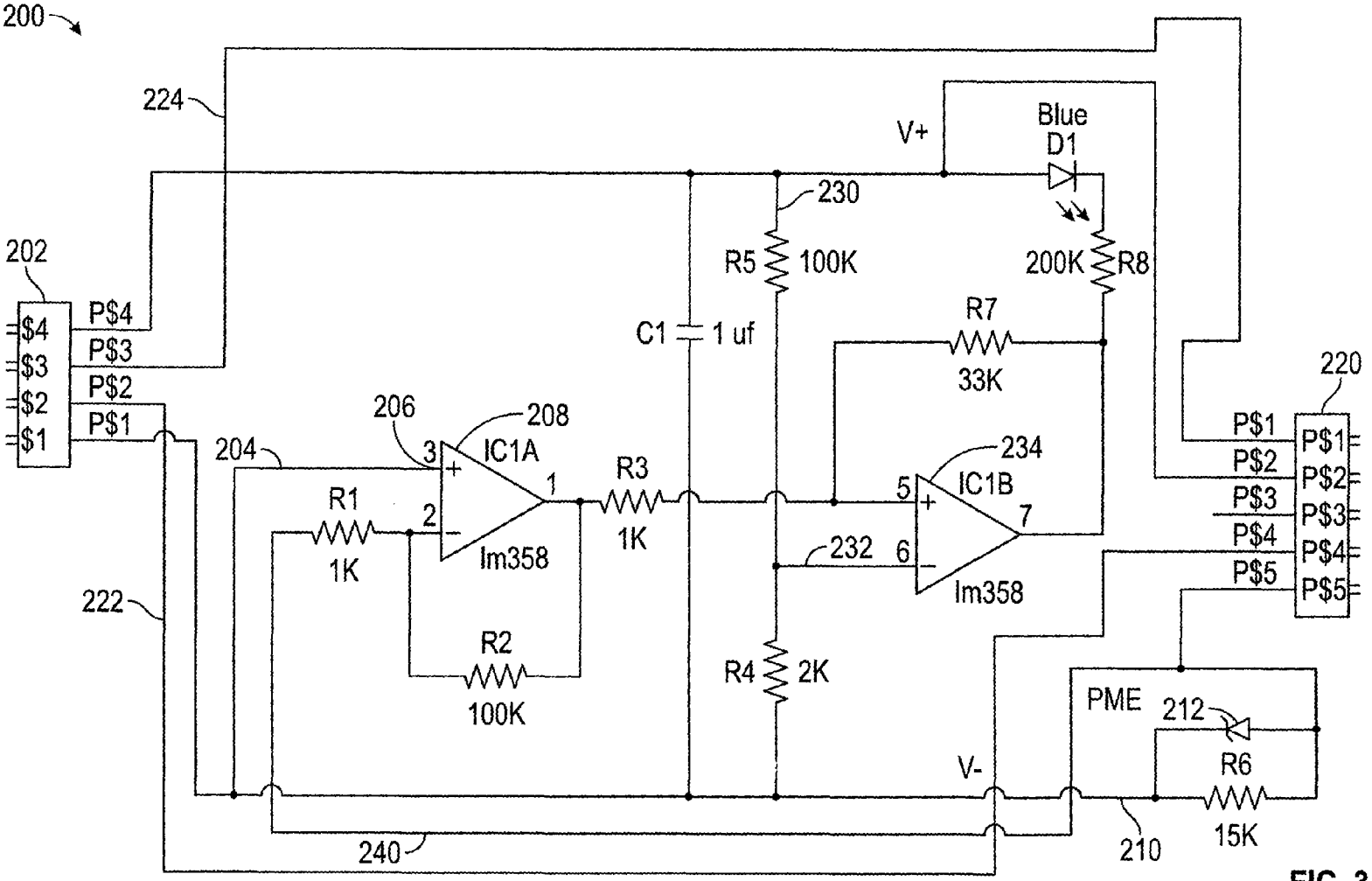
FIG. 3 shows an exemplary electronic circuit diagram of the charging cable assembly shown in FIG. 1.

Referring to FIG. 3, an exemplary schematic drawing of an electronic circuit 200 of cable assembly 100 that achieves the desired results discussed above is provided. In an exemplary embodiment, the electronic components of electronic circuit 200 are located in connection end 106 of cable assembly 100, although those skilled in the art will recognize that electronic components can be located in electrical power connection end 102 of cable assembly 100.

A first connector 202 includes a plurality of pins, of which four pins P$1, P$2, P$3, and P$4 are used. P$1 includes a first conductor 204 that is connected to a positive input of a first amplifier 208. P$1 also includes a second conductor 210 that is connected to a resistor R6. In an exemplary embodiment, resistor R6 has a resistance of 0.15 ohms, although those skilled in the art will recognize that resistor R6 can have other resistance values as well, depending on device range.

A Schottky diode 212 is placed in parallel with resistor R6. The Schottky diode is used to lower the energy wastage when the device is drawing higher current (>1 Amp) as it limits the current drop across R6 to about 0.2 thus this unique usage saves power, reduces heat on R6 and thus increases reliability of the system. The Schottky diode may use different technologies having different values as semiconductor technology improves and devices with lower forward voltage drop becomes commercially available. A third conductor 240 electronically connects resistor R6 and Schottky diode 212 to pin number P$5 on a second connector 220.

A fourth conductor 222 electrically connects a pin P$2 on first connector 202 to a pin P$4 on second conductor 220, while a fifth conductor 224 electrically connects a pin P$3 on first connector 202 to a pin P$1 on second connector 220. A sixth conductor 226 electrically connects a pin P$4 on first connector 202 to a pin P$2 on second connector 220. Fourth conductor 222 and fifth conductor 224 provide electrical connections for USB standard data between electrical power source 50 and electronic device 52 when cable assembly 100 is electrically connected to both electrical power source 50 and electronic device 52.

A capacitor C1 electrically connects sixth conductor 226 to fourth conductor 222. In an exemplary embodiment, capacitor C1 has a capacity of 1 μF, although those skilled in the art will recognize that capacitor C1 can have other values as well. Additionally, a seventh conductor 230 electrically connects sixth conductor 226 to fourth conductor 222. A resistor R5 is located along seventh conductor 230. In an exemplary embodiment, resistor R5 has a resistance of 100,000 ohms, although those skilled in the art will recognize that resistor R5 can have other values as well. Additionally, a resistor R4 is located along seventh conductor 230. In an exemplary embodiment, resistor R4 has a resistance of 2000 ohms, although those skilled in the art will recognize that resistor R4 can have other values as well.

An eighth conductor 232 provides electrical connection between seventh conductor 232 a negative input of a second amplifier 234. The connection at seventh conductor 232 is between resistor R5 and resistor R4. A ninth conductor 240 connects third conductor 214 to a resistor R1. In an exemplary embodiment, resistor R1 has a resistance of 1000 ohms, although those skilled in the art will recognize that resistor R1 can have other values as well. The output of resistor R1 is also electrically connected to a negative input of amplifier 208. The output of amplifier 208 is electrically connected to a resistor R3. In an exemplary embodiment, resistor R3 as a resistance of 1000 ohms, although those skilled in the art will recognize that resistor R3 can have other values as well.

A resistor R2 is connected in parallel to amplifier 208, between the negative input of amplifier 208 and the output of amplifier 208. In an exemplary embodiment, resistor R2 has a resistance of 100,000 ohms, although those skilled in the art will recognize that resistor R2 can have other values as well. An output of resistor R3 is electrically connected to a positive input of amplifier 234. The output of amplifier 234 is electronically connected to a resistor R8. In an exemplary embodiment, resistor R8 has a resistance of 200 ohms, although those skilled in the art will recognize that resistor R8 can have other values as well.

A resistor R7 is located is series with resistor R3 and in parallel between the positive input of amplifier 234, and the output of amplifier 234. In an exemplary embodiment, resistor R7 is a value of 33,000 ohms, although those skilled in the art will recognize that resistor R& can have other values as well. Diode D1 is electrically connected between resistor R8 and sixth conductor 226. Diode D1 provides illumination to connection end 106 of USB cable 100 when power connection end 102 is electrically connected to a power source 50 and connection end 106 is not connected to any other electronic device. First conductor 204 and sixth conductor 226 provide electrical power to diode D1.

Resistors R3 and R7 introduce a hysteresis such that, at the end of charging device 52 fluctuating current is a minimum of about 1 mA and a maximum of about 20 mA. If diode D1 turns off the current of 10 mA, diode D1 remains off for any current greater than 10 mA. When the current at diode D1 decreases to less than 10 mA due to the behavior of charged device 52, diode D1 will not turn on but will remain off below 10 mA. This feature is dependent upon resistor R3 and resistor R7 being connected in series, with the electrical connection to the positive input of amplifier 234 being between resistor R3 and resistor R7, the ratio of the resistance of resistor R3 to the resistance of resistor R7 (about 1:33), and the value of the voltage at the negative input terminal of amplifier 234, thereby eliminating any tendency of diode D1 to flicker due to small changes in the current at the end of the charge cycle of electronic device 52.

The value of resistor R2 is provided so that at a very light load of 500 μA, diode D1 turns off. Schottky diode 212 comes into conduction at a current of greater than 1.5 A.

The above-described electronic circuit is one way to provide the desired function of USB cable assembly 100, although those skilled in the art will recognize that the desired function of USB cable assembly 100 may be provided by using other types of electronic circuits.

In operation, a user plugs power connection end 102 of cable assembly 100 into electrical power source 50. The electrical power from electrical power source 50 illuminates diode D1 at device connection end 106 so that the user can see the location of device connection end 106, even in a dark room. The user then plugs device connection end 106 into electronic device 52, such that electronic device 52 is electrically charged from electrical power source 50, through cable assembly 100. When device connection end 106 is plugged into electronic device 52, electronic circuit 200 causes diode D1 to shut off and cease to be illuminated. Even after electronic device 52 is fully charged, diode D1 will not be illuminated until device connection end 106 is disconnected from electronic device 52, at which time, if power connection end 102 is still electrically connected to electrical power source 50, diode D1 will again illuminate.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. An electronic charging cable assembly comprising:

a power connection end adapted to be electrically connected to an electrical power source;

a device connection end adapted to be electrically connected to an electronic device, the device connection end being electrically connected to the power connection end;

a light source located at the device connection end such that, when the power connection end is electrically connected to the electrical power source and the device connection end is not connected to the electronic device, the light source is illuminated and, when the power connection end is electrically connected to the electrical power source and the device connection end is connected to the electronic device, the light source is not illuminated; and first resistor electrically connected to the power connection end such that the light source is not illuminated until the electronic device is disconnected from the device connection end.

2. The electronic charging cable assembly according to claim 1, further comprising a cable electrically connecting the power connection end and the device connection end.

3. The electronic charging cable assembly according to claim 1, further comprising an electronic circuit electrically coupled to the power connection end and to the device connection end, wherein the light source is part of the electronic circuit.

4. The electronic charging cable assembly according to claim 3, wherein the electronic circuit comprises a Schottky diode.

5. The electronic charging cable assembly according to claim 4, wherein the Schottky diode is activated when an electrical current in the electronic circuit exceeds about 1.5 A, which decreases energy wastage.

6. The electronic charging cable assembly according to claim 4, wherein the Schottky diode is in parallel with a resistor.

7. The electronic charging cable assembly according to claim 3, wherein the electronic circuit comprises first and second electrical conductors adapted to provide electrical power from electrical power source to the electronic device, and wherein the electronic circuit further comprises third and fourth electrical conductors adapted to provide electrical power from the power connection end to the light source.

8. The electronic charging cable assembly according to claim 7, further comprising a second resistor located in the third electrical conductor between the power connection end and the light source.

9. The electronic charging cable assembly according claim 8, wherein a ratio of the resistance of the first resistor to the resistance of the second resistor is about 1:33.

10. A method of charging an electronic device, comprising the steps of:

(a) providing the electronic charging cable assembly according to claim 1;

(b) electrically connecting the power connection end to the electrical power source, thereby illuminating the light source;

(c) electrically connecting the device connection end to the electronic device, thereby turning off the illumination of the light source; and (d) re-illuminating the light source only after electronic device is electrically disconnected from the device connection end.

11. The method according to claim 10, wherein step (d) comprises using hysteresis to prevent re-illumination of the light source until the electronic device is electrically disconnected from the device connection end.

12. The method according to claim 10, wherein step (d) comprises using a Schottky diode to prevent re-illumination of the light source until the electronic device is electrically disconnected from the device connection end.

13. An electronic charging cable assembly comprising:

a power connection end adapted to be electrically connected to an electrical power source;

a device connection end adapted to be electrically connected to an electronic device, the device connection end being electrically connected to the power connection end via first and second electrical conductors;

a light source located at the device connection end; and an electronic circuit electrically connected to the device connection end, to the power connection end, and to the light source, the electronic circuit comprising:

a third conductor and a fourth conductor, each of the third conductor and the fourth conductor electrically connecting the device connection end to the power connection end;

a first resistor directly connected to the third conductor, the first resistor introducing hysteresis such that the light source is not illuminated until the electronic device is disconnected from the device connection end; and a Schottky diode in parallel with the first resistor.

14. The electronic charging cable assembly according to claim 13, wherein the electronic circuit further comprises:

the first resistor and a second resistor in series between the third conductor and the light source; and an amplifier in parallel with the second resistor.

15. The electronic charging cable assembly according to claim 14, wherein the first resistor and the second resistor have a resistance ratio of about 1:33.

* * * * *